US006397431B1

(12) United States Patent
Alonso

(10) Patent No.: US 6,397,431 B1
(45) Date of Patent: Jun. 4, 2002

(54) SPRING ASSEMBLY NORMALLY INACTIVE THAT OPTS FOR CAUSING TOWARDS ANY POSITION WITH RECIPROCATIVE DOOR CLOSER DEVICES

(76) Inventor: Ricardo Alonso, 111 S. Perry St., Denver, CO (US) 80219

( * ) Notice: Subject to any disclaimer, the term of this patent is extended or adjusted under 35 U.S.C. 154(b) by 0 days.

(21) Appl. No.: 09/473,822

(22) Filed: Dec. 28, 1999

(51) Int. Cl.[7] ..... E05F 1/08
(52) U.S. Cl. ..... 16/72; 16/71; 16/66
(58) Field of Search ..... 16/67, 66, 71, 16/72

(56) References Cited

U.S. PATENT DOCUMENTS

| | | | | |
|---|---|---|---|---|
| 511,299 | A | * | 12/1893 | Larsson et al. |
| 759,621 | A | * | 5/1904 | Lackey |
| 1,662,395 | A | * | 3/1928 | Notron |
| 1,675,980 | A | * | 7/1928 | Lebherz |
| 2,042,954 | A | * | 6/1936 | Memmel |
| 2,732,920 | A | | 1/1956 | Newton |
| 2,920,338 | A | | 1/1960 | Falk |
| 3,032,806 | A | | 5/1962 | Mallory |
| 3,162,889 | A | | 12/1964 | Runnels |
| 3,249,961 | A | * | 5/1966 | Quinn |
| 3,413,679 | A | * | 12/1968 | Waldo |
| 3,566,435 | A | | 3/1971 | Nakamura |
| 3,665,549 | A | * | 5/1972 | Quinn |
| 4,194,264 | A | | 3/1980 | Stoffregen |
| 4,486,917 | A | * | 12/1984 | Johnston et al. |
| 4,648,151 | A | * | 3/1987 | Whaley |
| 4,777,698 | A | | 10/1988 | Lord |
| 4,815,163 | A | | 3/1989 | Simmons |
| 5,649,339 | A | * | 7/1997 | Reed |
| D395,995 | S | | 7/1998 | Alonso |
| 5,829,098 | A | | 11/1998 | Alonso |
| 5,953,789 | A | | 9/1999 | Alonso |

FOREIGN PATENT DOCUMENTS

| | | |
|---|---|---|
| CA | 623038 | 4/1961 |

* cited by examiner

*Primary Examiner*—Anthony Knight
*Assistant Examiner*—Vishal Patel

(57) ABSTRACT

An assembly (50) adapted to a reciprocative door closer device (10) and contingent door (62), the device (10) comprising a rod (16) and a body (12) having a biasing means (11) normally operating to comprise decreasing actuation and causing the rod (16) and door (62) towards a closed position (62-A); the assembly (50) including a hinge bracket (50-A) joined to a fixated bracket (50-A) and a spring means (54) capable of a ligamentous movement (55) normally operating as substantially inactive, unless, said assembly (50) detects an excessive inward force (11-B) exceeding said device (10), wherein said assembly (50) responsively opts to regulate increasing actuation towards the closed position (62-A) without cause to said rod (16), to dampen, protect, and compensate said excessive force (11-B) and return said device (10) and door (62) towards normal operation.

2 Claims, 5 Drawing Sheets

*FIG. 5*

List of Reference Numerals

10 reciprocative device

11 biasing means of 10
- 11-A outward biasing force
- 11-B inward biasing force

12 piston body of 10

15 damper cover of 10

16 piston rod of 10

22 checking mechanism of 10

48 lug mount of 12

50 torsion assembly of 10
- 50-A hinge bracket
- 50-B fixated bracket

52 fasteners holes of 50-B

53 carriage bolts of 52
- 53-A treaded nut of 53

54 torsion spring of 50

55 ligamentous movement of 54

56 lug pin of 48

58 link pin 50-A

60 clip plate of 10

61 doorjamb bracket of 60

62 contingent door of 10
- 62-A closed position
- 62-B opened position
- 62-C dampened position

63 outermost edge of 62

64 doorjamb of 62

66 door hinge of 62

68 door frame of 62

PRIOR ART

SPRING ASSEMBLY NORMALLY INACTIVE THAT OPTS FOR CAUSING TOWARDS ANY POSITION WITH RECIPROCATIVE DOOR CLOSER DEVICES

TECHNICAL FIELD

This invention relates to various reciprocative devices comprising a rod that functions from within a body controlling a biasing means. A prior art reciprocating door closer installed on a contingent screen or storm door exemplifies such a device. The device comprises normal operation to substantially cause the door towards a closed door position. The door closer is normally loosely mounted with a checking mechanism for engaging and checking the biasing means and holding the door in an opened position. More particularly, this invention relates to an improved apparatus and methodology to dampen the device and door to protect from damage due to excessive inward biasing forces caused when the door is held opened by an engaged checking mechanism, then urged towards a closed position without first the mechanism, particularly if the mechanism is of superior nature as describe in U.S. Pat. No. 5,953,789 to Alonso.

The reader will also realize that the inventions disclosed herein may be adapted onto other reciprocative devices including those not equipped with a superior checking mechanism. The invention may be incorporated with U.S. Pat. Nos. 5,829,098 and 6,032,331 both to Alonso, for creating a preferred door closer device.

BACKGROUND ART

A portion of the disclosure of this patent document contains material which is subject to copyright protection. The copyright owner has no obligation to the facsimile reproduction by anyone of the patent document or the patent disclosure, as it appears in the Patent And Trademark Office patent file or records, but otherwise reserves all copyright whatsoever.

A brief description of a prior art reciprocative device includes a basic door closure device which is controlled with liquid or gas. The device may typically contain a piston assembly including a piston with sealing o-ring; piston rod varieties which include curved and non-curved surfaces; internal compression spring operators and hydraulic biasing operators for controlling the biasing forces; a cylindrical piston body; scaled and non-sealed end caps and grommets; fluid restriction valves; attachment members; and the checking mechanism which holds the door opened. Such door closer devices are described in U.S. Pat. Nos. 2,732,920; 2,920,338; 3,032,806; 3,162,889; 3,566,435; 3,665,549; 4,777,698; and Can. Pat. No. 623,038.

Most prior art reciprocative door closer device normally operate comprising at least one rod which functions reciprocatively from within a body having an internal biasing means. The biasing means actuates to control two distinctive biasing forces common to the device and the door; an outward biasing force, that is increasingly actuated while causing the rod and door towards the opened position; and, an inward biasing force which is decreasingly actuated while causing the rod and door towards the closed position. Upon applying an external outward force, the biasing means acts to counter and control the inward force. The applicant believes that despite origin of the biasing forces, either if caused externally as through human interference or caused internally as from the device, the two forces are clearly and distinctly taught as absolutely equating towards the device operation and the door position.

The checking mechanism is for engaging and checking the inward force, and holding said rod and door towards any opened position. The hold-open feature is externally activated by first opening the door to a desired position, thus creating outward biasing forces which increasingly extends the rod from within the body, and, increasingly actuate pressure within the body at the biasing operators for the biasing means. The inward biasing force is then normally decreasingly actuated to return the rod and close the door, causing as a result of the biasing operators. The checking mechanism is axially mounted onto the rod through an aperture configuration, first by moving the mechanism to a desired position on the extended rod. Releasing the door, the internal operator acts to return the rod towards the normally retracted position within the body. Once the piston body and end cap contacts the mechanism upon the trigger area, the biasing force causes the mechanism to lever. A direct frictional pressure is torsionally created by opposing points comprised within the aperture that is then applied onto surfaces of the piston rod, whereby the mechanism frictionally checks the device. More biasing force controlled by the internal operator results in more direct pressure causing the friction onto the surfaces of the rod.

The art has never before revealed any substantial reason to dampen the door closer device and contingent door to protect from damage due to excessive inward biasing forces, nor to compensate for a superior checking mechanism. When a door is being held opened with an engaged superior checking mechanism holding the rod, excessive inward forces can be generated by an unsuspecting person's attempt to close the door without first disengaging the mechanism. Because the rod can not reciprocate back towards the body, the extended rod therefore becomes excessive and may subject the door and device to extensive damage. A superior mechanism that is substantially tempered and hardened may not reveal any give to compensate for the excessive inward force. Not realizing that the checking mechanism is actually holding the door opened, the unsuspecting person's psychological then physical reaction may be to push harder in an effort to close the door, thus further increasing the inward forces for the device, which comprises a decreasing actuation towards the closed position.

Tremendous leverage may be quickly generated by pushing on the outermost edge of the door. Substantial damage to various components may include the contingent door and door frame, and the door closer device. If the device is not equipped with a clip plate to accommodate the doorjamb bracket, the bracket may be forcibly detached from atop the doorjamb. Because the device is typically fastened to the door with sheet metal screws that do not penetrate the entire substance of door, such as with a bolt and threaded fastener nut, the device may then be forcibly detached from atop the door. Most prior art mechanisms are manufactured from common sheet steel which is relatively soft and easily fail when placed under similar excessive inward forces. These and other issuers create a shortened life span for the device, which coincidentally offers the industry certain obsolescence resulting in frequent consumer purchases. The reader will also realize that the invention may be adapted onto any device including those not equipped with a superior checking mechanism.

FIG. 6 illustrates a normally operational prior art door closer device (10) not to be confuse as anticipating the inventive concepts submitted herein. The coil spring assembly (50) is adapted to communicate with the rod (16), to comprise a partial biasing means operator (11), only for protecting the device (10) and door (62 not shown) from an excessive outward biasing force (11-A) such as from a sudden wind gust that could force the door beyond a normal opened position. As the rod (16) is maximally extended from the body (12) creating increasingly outward biasing force (11-A), the coil spring assembly (50) dampens by providing a reciprocative decreasing inward biasing force (11-B) to cause the rod (16) again towards the body (12). The spring (50) constantly and increasingly actuate throughout the entire normal operation for the device (10), as the spring (50) comprises the sole link between the doorjamb bracket (61) and the rod (16). Even if the checking mechanism (22) were engaged to hold the rod (16) in a opened position (62-B), then urged towards a closed position (62-A) to create excessive inward forces (11-B), the assembly (50) absolutely would not dampen, protect, nor compensate the device (10).

It is unclear as to why the art would offer such this assembly on the exterior piston rod of the device, as a similar and simpler assembly has long been implemented on the interior of the body comprising a loosely mounted coil spring or similar mechanism acting with the rod to actuate when the rod is maximally extended, as shown in U.S. Pat. No. 3,665,549 Quinn (36). Certainly replacement options for the prior art checking mechanism have been eliminated. I believe that this exterior assembly merely complicates the device and does not offer any substantial benefit over the previous interior assembly. Respectfully, none of the disclosures of this prior art assembly are anticipated, required, initiated, nor beneficial towards the superior inventions disclosed herein.

DISCLOSURE OF THE INVENTION

The present invention comprises a spring assembly adapted to dampen and protect the complete door closer device and contingent door from damage due to any excessive inward biasing forces caused when the door is held opened by an engaged checking mechanism, then urged towards a closed position without first releasing the mechanism. An object of these inventions are to dampen and protect the door closer and door from an unsuspecting person who pushes the door held opened with a superior checking mechanism that is substantially tempered and hardened. Another object of these inventions are to dampen and protect from damage due to leverage generated by pushing on the outermost edge of the door. Another object of these inventions are to protect the doorjamb bracket from forceful detachment when not equipped with a clip plate. Another object of these inventions are to increase the life of a prior art non-hardened, nor tempered checking mechanism.

The assembly may comprise a hinge bracket joined to a fixated bracket, and a torsion spring means capable of providing an abrupt ligamentous movement, that will not substantially actuate during normal operation for the device, and, will not substantially cause the door either towards any closed position or any opened position, unless the spring encounters excessive inward force which may exceed the normal operation for the device. An object of these inventions are to responsively compensate for excessive inward force. Another object of these inventions are to detour the unsuspecting person's psychological then physical reaction to push harder in an effort to close a door held opened with any checking mechanism. Another object of these inventions are to immediately return the door closer devise to a normal operation and the door to a normal position.

The assembly may be incorporated on the opposite end of the piston rod, commonly the body of the device. An object of these inventions are to comprise a normally increasing actuation for causing the door towards any closed position, and, a normally decreasing actuation for causing the door towards any opened position, with absolutely no cause to the rod. Another object of these inventions are to immediately return the door closer devise to a normal operation and the door to a normal position. Another object of these inventions are to opt for checking mechanism removal and replacement. Another object of these inventions are to streamline the assembly into the device.

The fixated bracket may be attached to the door with carriage bolts and threaded nuts or similar threaded fasteners, for penetrating the entire substance of the door. An object of these inventions are to improve the fastener screws for the fixated bracket. Another object of these inventions are to provide maximum strength for the bracket. The hinging members and other components may be substantially tempered and hardened. An object of these inventions are to provide long life for the door closer device.

These and further objects and advantages of the invention will be apparent from the following description of the preferred embodiments thereof.

BRIEF DESCRIPTION OF THE DRAWINGS

FIG. 5 is a reference list.

Prior Art

Figure 6:
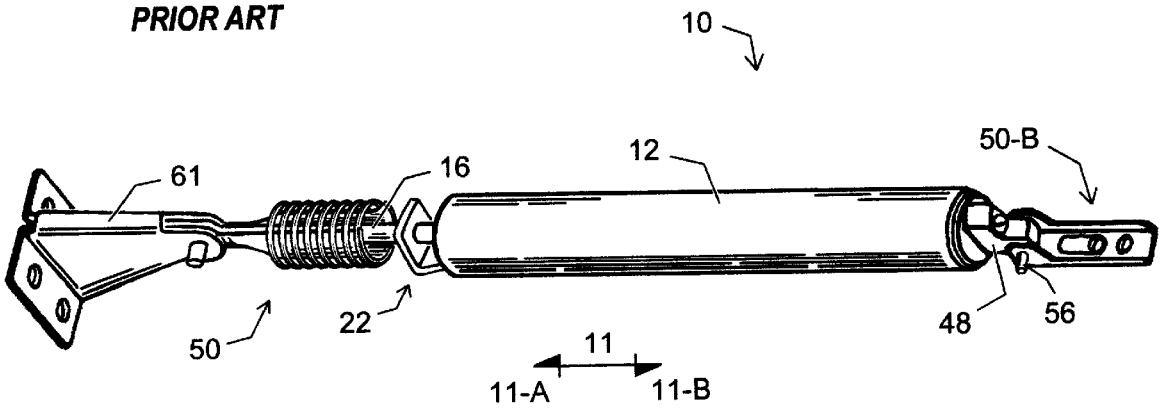

FIG. 6 is a prior art door closer device providing a damper assembly as a biasing means, adapted on the exterior piston rod to protect from excessive and increasingly outward biasing forces only.

Best Modes for Carrying Out the Invention

Figure 1:
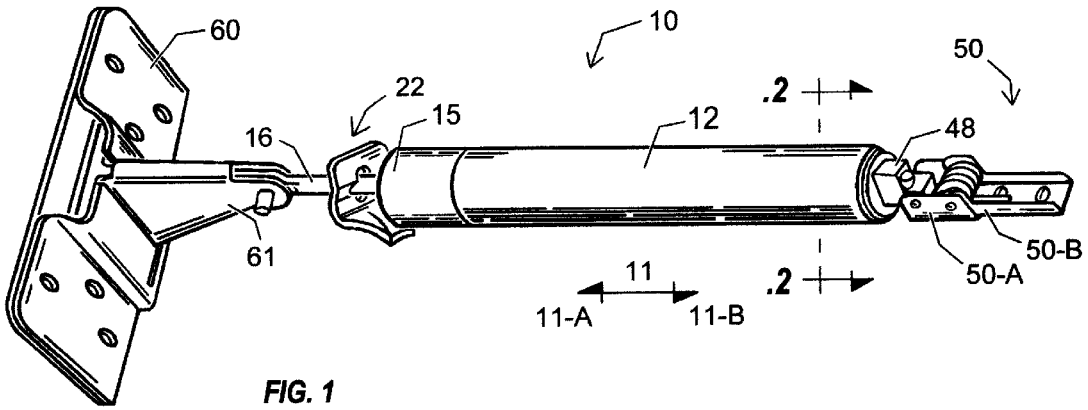
FIG. 1 if a prospective view of a superior door closer device in a closed position, comprising a piston rod within a body controlling a biasing means, and a superior checking mechanism. The invention, a spring assembly to protect from excessive inward biasing forces is also shown in a closed position.
Figure 2:
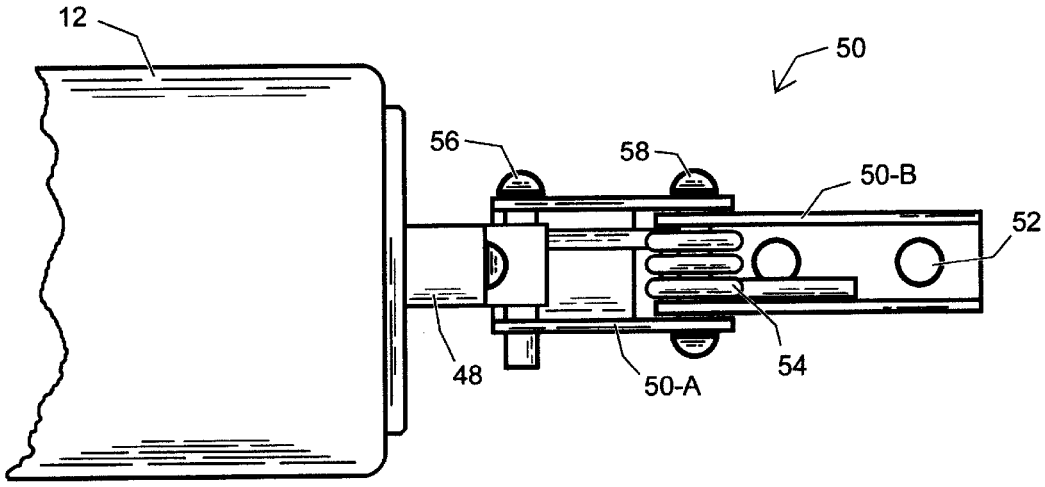
FIG. 2 is a frontal view of the torsion assembly of FIG. 1.

FIGS. 1–2 are taught conceptually together wherein FIG. 1 is a prospective view of a superior door closer 10 shown comparable to closed position 62-A, comprising a piston rod 16 within a piston body 12 controlling a biasing means 11. The biasing means (11) controls and operates two distinctive biasing forces common to the device 10 and the door 62. An outward biasing force 11-A comprises normally increasing actuation for causing the rod 16 and door 62 towards an opened position 62-B, and an inward biasing force 11-B comprising normally decreasing actuation for again causing the rod 16 and door 62 towards the closed position 62A. The forces can originate and be influenced either externally as through human interference, or internally as from the device 10. The two forces clearly equate towards the operation of the device 10 and the position door 62. A superior, substantially tempered and hardened checking mechanism 22 is mounted onto the piston rod 16 for checking and holding the inward force 11-B. A clip plate 60 is accommodating the doorjamb bracket 61 which normally mounts atop a doorjamb. The invention, a spring assembly 50 is adapted onto the opposite end of the piston rod 16, primarily comprising a hinge bracket 50-A, a link pin 58, a fixated bracket 50-B, and a torsion spring 54.

FIG. 2 is a frontal view of the damper assembly 50 attached to the lug mount 48 which accommodates a lug pin 56 for fixating the assembly 50 onto the device 10. The assembly 50 comprises a hinge bracket 50-A which is attached to the mount 48 of the body 12, and a fixated bracket 50-B providing fasteners holes 52 attachable to a contingent door 62 shown in FIG. 3. A torsion spring 54 is adapted onto a link pin 58, for the purpose of deflecting energy about the center axis of the pin 58, normally in any preferred direction of wind. The reader will note that the legs for the spring 54 are deflecting energy against the brackets 50-A and 50-B, holding the assembly 50 as in a normally closed position 62-A. The spring 54 will not cause any substantial ligamentous movement 55 while in the closed position 62-A nor in the opened position 62-B as shown in FIG. 3.

Figure 3:
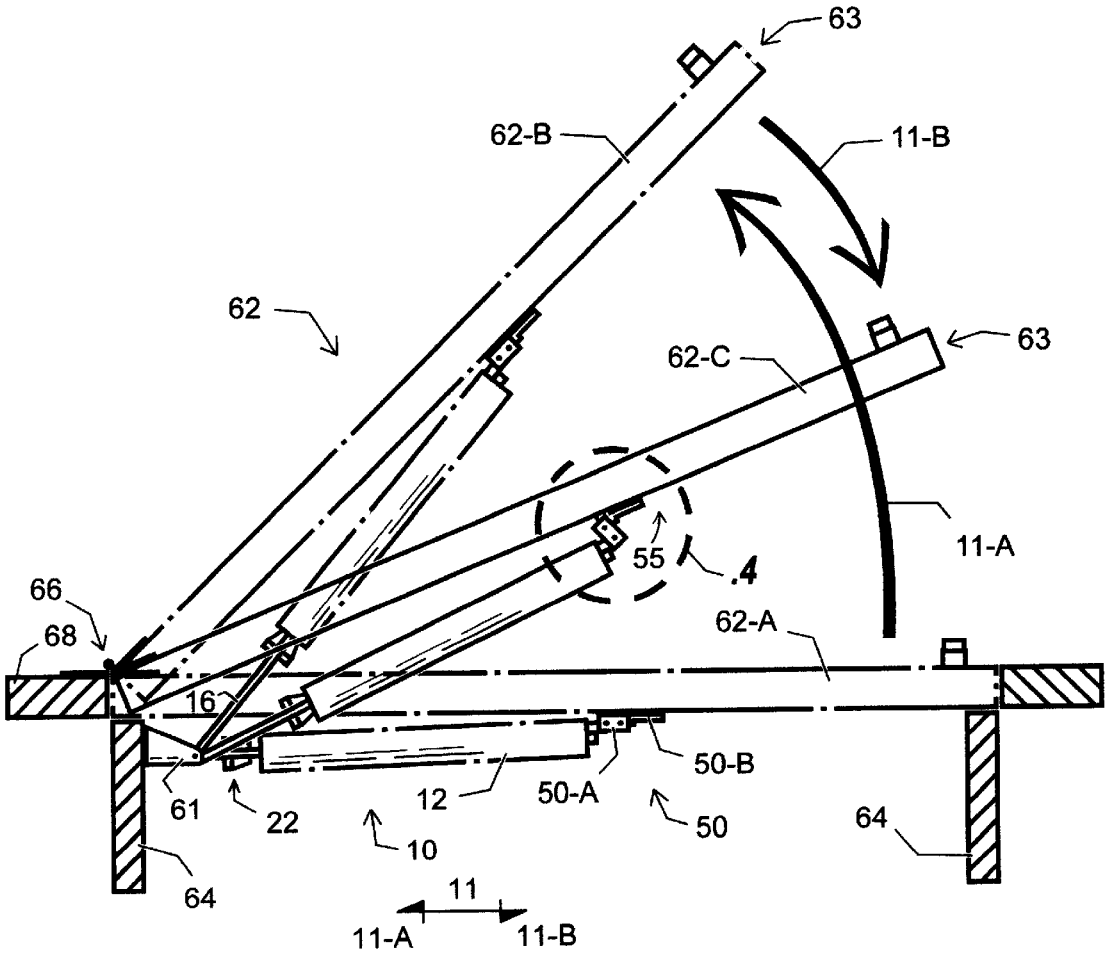
FIG. 3 is top view of the assembly adapted on the opposite end of the piston rod for the door closer device. The device and contingent door are shown in three positions: a closed position; an opened position; and a dampened position.
Figure 4:
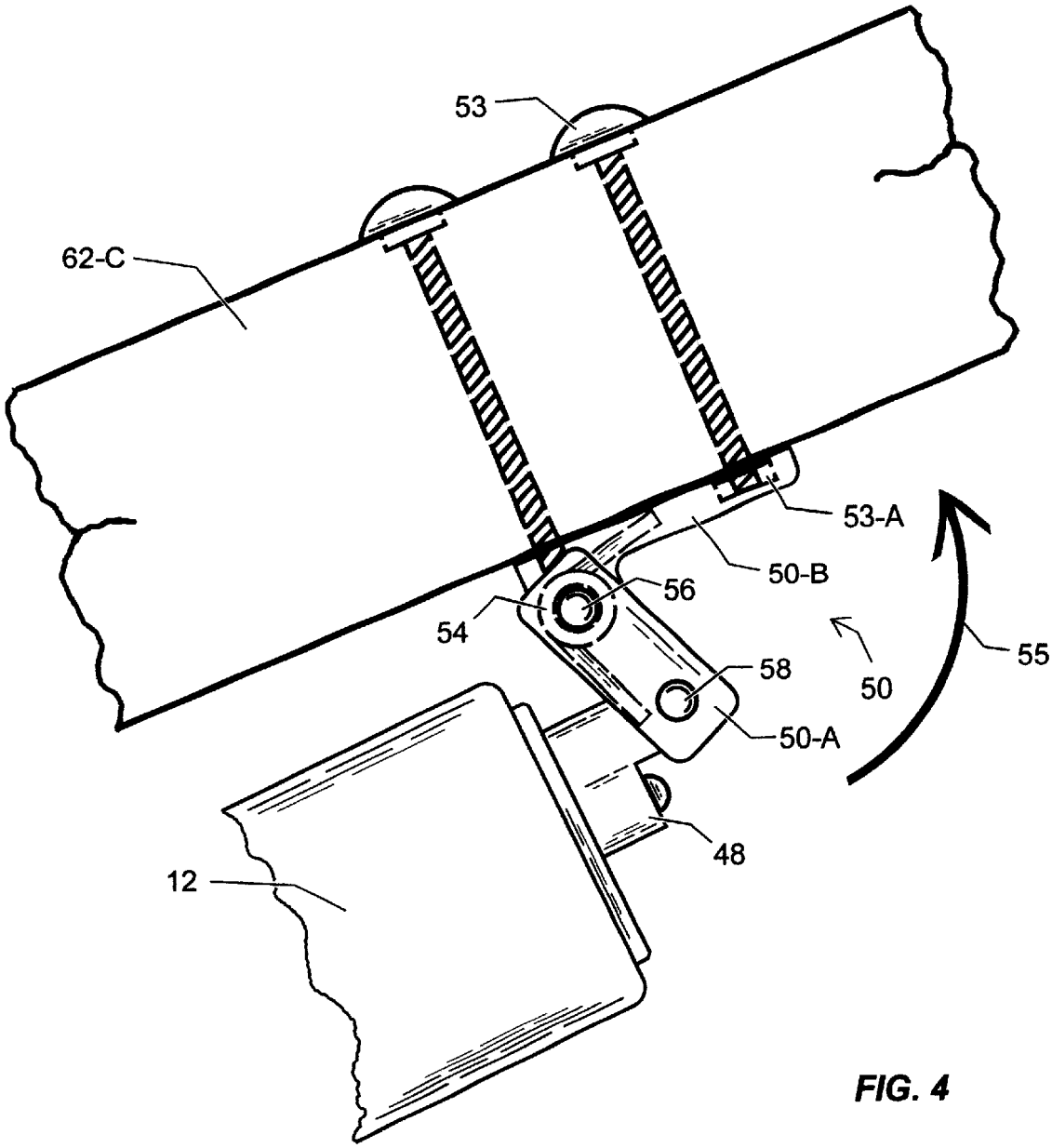
FIG. 4 is an enlarged view of the assembly of FIG. 3, comprising a normally increasing actuation for causing the door towards any closed position, and decreasing actuation for returning towards the opened position.

FIG. 3 and FIG. 4 are taught conceptually together wherein FIG. 3 is top view of a door closer device 10 and contingent door 62 shown in three positions: a closed position 62-A; an opened position 62-B; and a dampened position 62-C. Note that the checking mechanism 22 is engaged to hold the door and the inward force 11-B at the opened position 62-B. The door closer device 10 functions as the biasing means 11 permits extension of the rod 16 away from the body 12 with an increasing outward force 11-A, such as when a person moves the door 62 from the closed position 62-A towards the opened position 62-B. A decreasingly inward force 11-B controlled by the device 10 urges the rod 16 to retract into the body 12. The assembly 50 normally operates zero actuation as to not affect nor assist the biasing means I1 either towards any closed position 62-A, or, towards any opened position 62-B during the entire normal operation for the device 10.

FIG. 4 illustrates the simplistic ligamentous movement 55 of the spring assembly 50. To cause the spring 54 to actuate towards the dampened position 62-C, from the opened position 62-B the door must forcefully urged towards the closed position 62 without first disengaging said mechanism 22. Responsively, the assembly 50 and the spring 54 detect that the rod 16 has exceeded the normal operation for said device 10 to create the infamous excessive inward forces 11-B. The ligamentous movement 55 comprises a normally increasing actuation permitting the door 62 from any opened position 62-B towards any closed position 62-A, without any substantial cause or movement to the rod 16. Responsively, the assembly 50 also provides a decreasing actuation for reciprocatively causing the door 62 again towards the previous opened position 62-B as determined by the engaged mechanism 22. Herein, the assembly 50 actuates to dampen, protect, and compensate the device 10 from the excessive inward force 11-B, the return said device 10 to its normal operation as defined by the art.

Industrial Applicability

The preferred embodiments of these inventions improve reciprocative devices including the common door closer device. The disclosed invention comprises a spring assembly adapted to protect the complete door and door closer device from excessive inward forces, and to compensate for a substantially tempered and hardened checking mechanism. With certain devices, the assembly may be incorporated on the piston rod. The invention may be installed onto various other reciprocative devices that do not comprise superior checking mechanisms. These devices comprise a limited life due which may now be extended by the invention. Other benefactor devices may include automotive lift supports. When combining the invention with other related inventions, a superior reciprocative door closer device is obviously created.

The particular embodiments of the present invention which have been illustrated and discussed herein are for illustrative purposes only and are not considered as a limitation upon the scope of the appended claims. In these claims set forth it is my intent to claim the entire invention disclosed herein, except as I am limited by the prior art.

Accordingly, the scope of the invention should not be determined only by the embodiments illustrated, but also by the appended claims and their legal equivalents. From the above description of the invention submitted, various changes and modifications and improvements may occur to the apparatus. All such claims are intended to be included therein.

I claim:

1. A spring assembly (50) adapted to a reciprocative door closer device (10) and contingent door (62); said device (10) comprising normal operation to substantially cause said door (62) towards a closed door position (62-A); said device (10) including a piston rod (16) which functions reciprocatively from within a piston body (12) controlling a biasing means (11), that, upon an applying an external outward biasing force (11-A) comprising normally increasing actuation for causing said rod (16) and door (62) towards an opened position (62-B), said biasing means (11) acting to counter and control an inward biasing force (11-B) comprising normally decreasing actuation for again causing said rod (16) and door (62) towards the closed position (62-A) said device (10) further including a checking mechanism (22) for engaging and checking said inward force (11-B) and holding said rod (16) and door (62) towards an opened position (62-B); said assembly (50) comprising a hinge bracket (50-A) joined to a fixated bracket (50-B) and a spring (54) means capable of a ligamentous movement (55) comprising normal operation as substantially inactive and not affecting said biasing means (11), either for any increasingly outward force (11-A) towards the closed position (62-A), or, for any decreasingly inward force (11-B) towards the opened position (62-B), unless, said assembly (50) detects said inward force (11-B) as exceeding said device (10) including the excessive inward force (11-B) caused when the rod (16) and door (62) are held in any opened position (62-B) with an engaged checking mechanism (22) and urged towards any closed position (62) without first disengaging said mechanism (22);

wherein said assembly (50) responsively compensates said excessive inward force (11-B) conversely without cause to said rod (16), by then providing said ligamentous movement (55) to include am increasing actuation for causing said door (62) towards any closed position (62-A), and, a decreasing actuation for causing said door (62) again towards any opened position (62-B) to dampen, protect, and compensate from said excessive inward force (11-B) and return said device (10) and assembly (50) towards their normal operation.

2. An improved reciprocative door closer device (10) for controlling a contingent door (62); said device (10) normally operating to substantially cause said door (62) towards a closed door position (62-A) including a piston rod (16) which functions reciprocatively from within a piston body (12) having a biasing means (11), that, upon al applying an external outward biasing force (11-A) comprising normally increasing actuation for causing said rod (16) and door (62) towards an opened position (62-B), said biasing means (11) acting to counter and control an inward biasing force (11-B) comprising normally decreasing actuation for again causing said rod (16) and door (62) towards the closed position (62-A); said device (10) further including a checking mechanism (22) or engaging and checking said inward force (11-B) and holding said rod (16) and door (62) towards any opened position (62-B); said device (10) further including a spring assembly (50) comprising a hinge bracket (50-A) joined to a fixated bracket (50-B) and a spring means (54) opting a ligamentous movement (55) to dampen, protect, and compensate said device from excessive inward force (11-B) comprising said ligamentous movement (55) providing normal operation to actuate substantial zero force as to not positively contribute affecting said biasing means (11) either for any increasingly outward force (11-A) towards the closed position (62-A), or, for any decreasingly inward force (11-B) towards the opened position (62-B), unless, said assembly (50) detects that said inward force (11-B) has exceeded said device (10), including The excessive inward form (11-B) caused when the rod (16) and door (62) are held in any opened position (62-B) with an engaged checking mechanism (22) and urged towards any closed position (62) without first disengaging said mechanism (22);

wherein said assembly (50) responsively compensates said excessive inward force (11-B) conversely without cause to said rod (16) providing said ligamentous movement (55) to include an increasing actuation for causing said door (62) towards any closed position (62-A), and, a decreasing actuation for causing said door (62) again towards any opened position (62-B) to return said device (10) and door (62) towards normal operation.

* * * * *